US011075495B2

(12) United States Patent
Leonard et al.

(10) Patent No.: US 11,075,495 B2
(45) Date of Patent: Jul. 27, 2021

(54) CONNECTOR INSTALLATION TOOL

(71) Applicant: RAYTHEON COMPANY, Waltham, MA (US)

(72) Inventors: Kenneth Leonard, Waltham, MA (US); Kyle Davidson, Waltham, MA (US); Daniel C. Mcgowan, Waltham, MA (US)

(73) Assignee: RAYTHEON COMPANY, Waltham, MA (US)

( * ) Notice: Subject to any disclaimer, the term of this patent is extended or adjusted under 35 U.S.C. 154(b) by 285 days.

(21) Appl. No.: 16/211,505

(22) Filed: Dec. 6, 2018

(65) Prior Publication Data

US 2020/0185873 A1 Jun. 11, 2020

(51) Int. Cl.
*H01R 43/26* (2006.01)

(52) U.S. Cl.
CPC ..... *H01R 43/26* (2013.01)

(58) Field of Classification Search
CPC .... H01R 43/26; H01R 43/20; Y10T 29/53209
See application file for complete search history.

(56) References Cited

U.S. PATENT DOCUMENTS

| | | | | |
|---|---|---|---|---|
| 6,234,826 | B1 * | 5/2001 | Wilber | H01R 13/4368 439/352 |
| 6,821,159 | B2 * | 11/2004 | Munger, Jr. | H01R 13/645 439/680 |
| 8,932,084 | B2 * | 1/2015 | Thackston | H01R 13/5227 439/676 |
| 2004/0123458 | A1 * | 7/2004 | Korsunsky | H05K 1/117 29/874 |
| 2005/0075641 | A1 * | 4/2005 | Singhatat | A61B 17/15 606/86 R |
| 2007/0011857 | A1 * | 1/2007 | Francis | H01R 43/26 29/426.5 |
| 2016/0248188 | A1 * | 8/2016 | Upson | H01R 13/501 |
| 2017/0170601 | A1 * | 6/2017 | Chen | H01R 13/426 |
| 2017/0214168 | A1 * | 7/2017 | Schroll | H01R 13/641 |

* cited by examiner

*Primary Examiner* — Peter Dungba Vo
*Assistant Examiner* — Jose K Abraham
(74) *Attorney, Agent, or Firm* — Burns & Levinson, LLP; Joseph M. Maraia

(57) ABSTRACT

A tool that facilitates handling and alignment of a Micro-D connector while installing or coupling to another Micro-D connector. The tool squares up and aligns the two mating connectors to each other prior to them making any contact in order to prevent misalignment and possible damage to either, or both, of the connectors.

5 Claims, 6 Drawing Sheets

CONNECTOR INSTALLATION TOOL

BACKGROUND

As many a Manufacturing Engineer can attest to, they are regularly called upon to review MIL-DTL-83513 Micro-D connectors damaged by operator error during installation. The micro-D series of connectors is relatively small and there is very little margin for error when mating the connectors. When the operator misaligns the male connector with the corresponding female connector and then attempts to couple them together, the insulation and sockets on the male connector and the pins on the mating female connector are often destroyed. This frequently occurs when the female connector is mounted to a backplane or printed circuit board (PCB) where the connectors are positioned in cramped locations that makes consistently aligning and mating the connectors by hand difficult as the operator's fingers are awkwardly positioned.

The current practice of attempting to visually align the connectors and then insert the connector by hand is clearly not sufficient. The resulting damage to one, or both, of the connectors, and corresponding costs due to rework to the product are significant on a large scale. A manufacturer of a Micro-D connector provides guidance as to how to seat a connector once it is initially mated, however, this guidance does not address any initial misalignment of the mating connectors.

The instances of damage to connectors during assembly into a final product need to be reduced.

SUMMARY

A tool that facilitates handling and alignment of a connector while installing or coupling to another connector. The tool squares up and aligns the two mating connectors to each other prior to them making any contact.

In one aspect of the present disclosure, an installation tool for aligning a male connector with a female connector comprises a body portion having a distal end and a proximal end; a cavity, defined by first and second opposed side walls, provided in the body portion having a distal opening and a proximal opening corresponding to the body portion distal and proximal ends and, respectively; and first and second shoulders extending into the cavity, respectively, from the first and second opposed side walls, wherein a first predetermined distance between the first and second side walls provides a slip fit coupling corresponding to the first type of connector, and wherein the first and second shoulders are positioned a second predetermined distance from the body portion distal end, the second predetermined distance a function of a sum of the heights of male and female connectors of the first type.

A slot may be defined in a first surface of the body portion extending from the distal end to the proximal end.

The body portion may comprise at least one of: a plastic, aluminum, a ceramic or a metal.

The first and second shoulders may extend perpendicularly from the first and second opposed side walls and may do so without interfering with a coupling portion of a male connector positioned in the cavity and adjacent the first and second shoulders.

BRIEF DESCRIPTION OF THE DRAWINGS

Various aspects of the disclosure are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The Figures are provided for the purposes of illustration and explanation and are not intended as a definition of the limits of the disclosure. In the Figures.

DETAILED DESCRIPTION

Details are set forth in order to provide a thorough understanding of the aspects of the disclosure. It will be understood by those of ordinary skill in the art that these may be practiced without some of these specific details. In other instances, well-known methods, procedures, components and structures may not have been described in detail so as not to obscure the aspects of the disclosure.

Generally, and as will be described in more detail below, one aspect of the present disclosure is directed to a tool to align male and female Micro-D type connectors to one another to reduce the instances of damage during assembly. Although Micro-D connectors are referenced herein, this is only for purposes of explanation and the disclosure is not limited to only these types of connectors as the teachings presented herein can be applied to other types of connectors.

Figure 1:
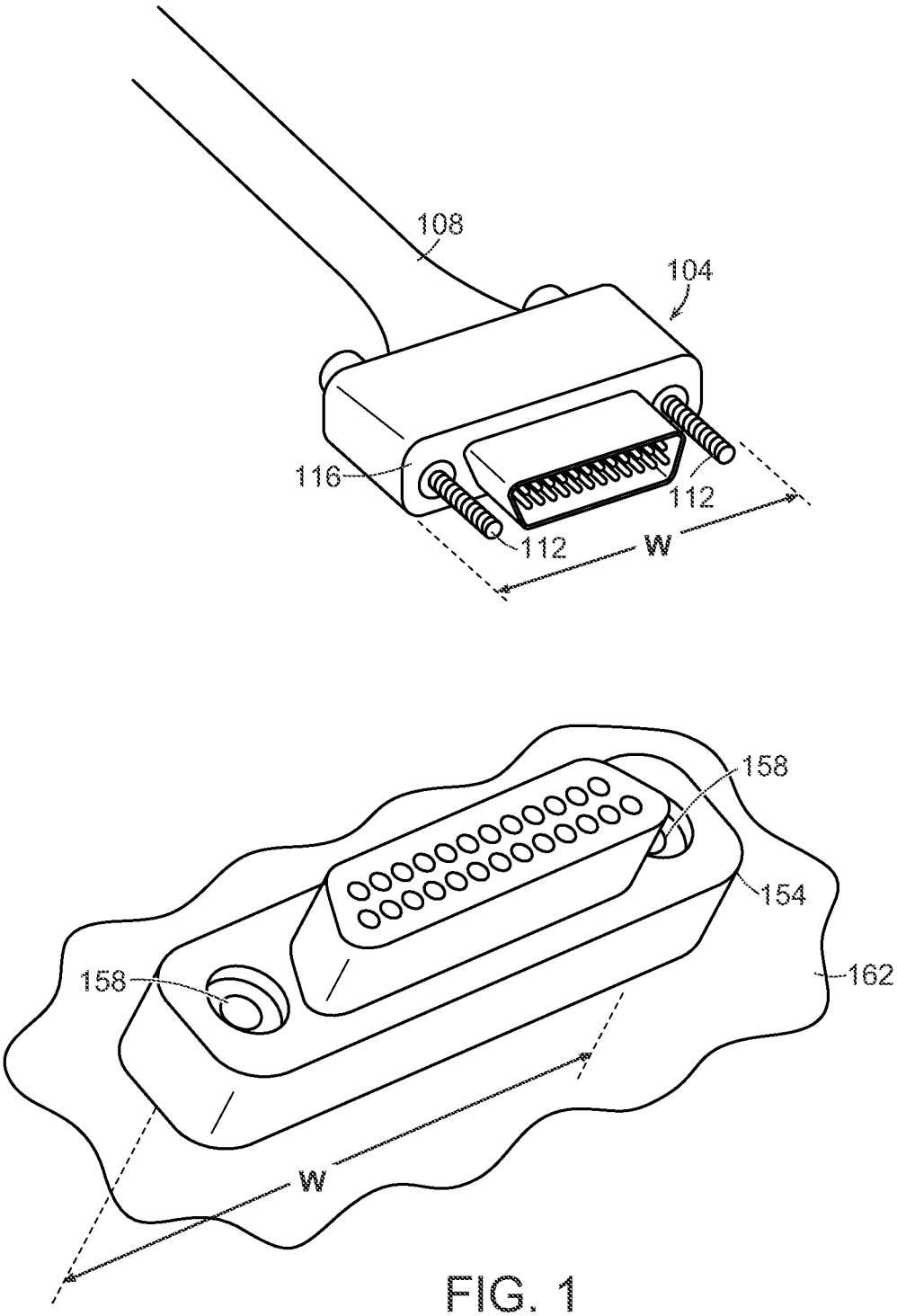
FIG. 1 is present male and female Micro-D connectors.

Referring to FIG. 1, as is understood by one of ordinary skill in the art, Micro-D connectors include a male connector 104 and a female connector 154. In one approach, the female connector 154 is soldered to a PCB 162, for example, a backplane, and coupled to the male connector 104. The male connector 104 includes a cable 108 and two captive screws 112 that are inserted in corresponding holes 158 in the female connector 154. The screws 112 extend through a distal surface 116 of the male connector 104. It is the initial misalignment between the male and female connectors 104, 154 and the subsequent tightening of the screws 112 that often leads to the damage described above.

Figure 2:
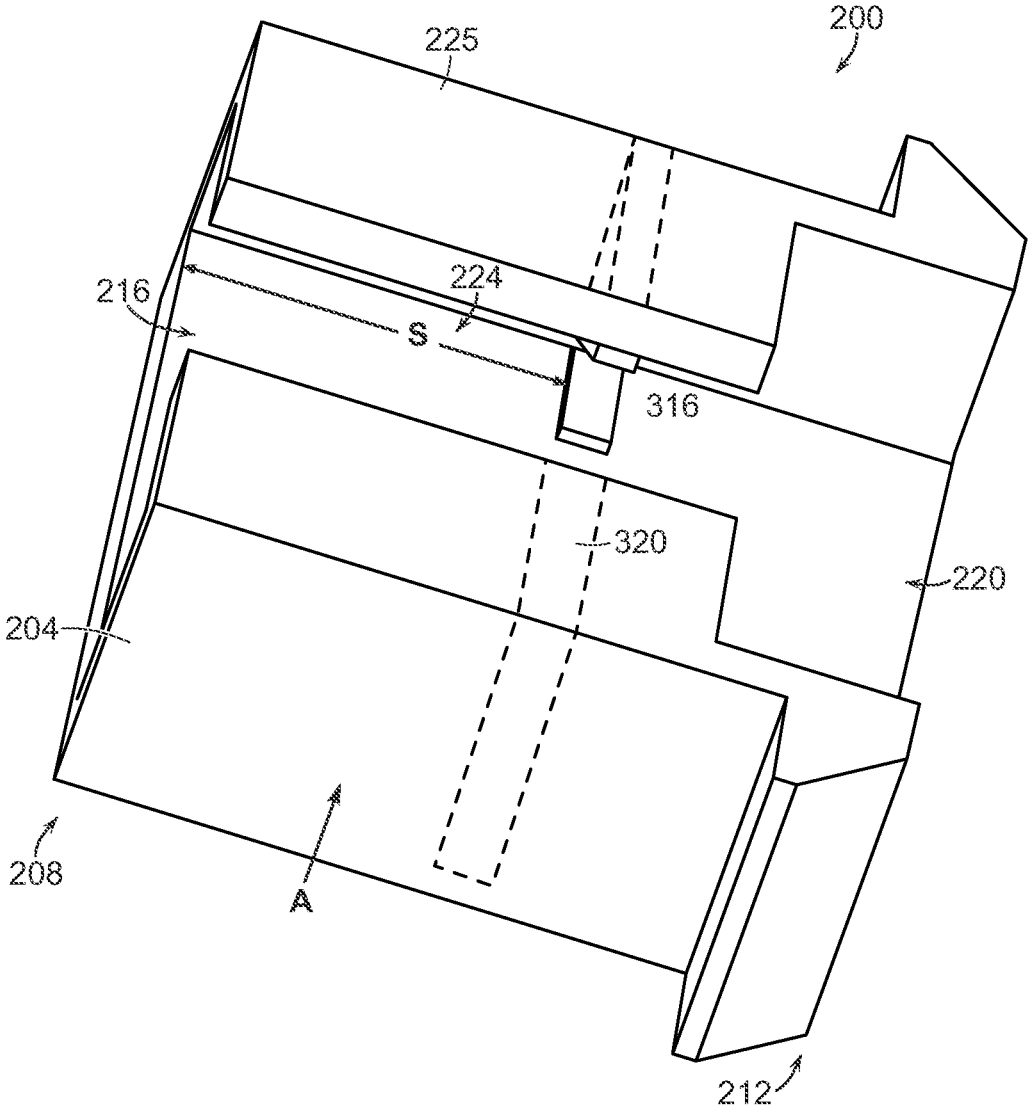
FIG. 2 is an alignment tool in accordance with an aspect of present disclosure.

An alignment tool 200 in accordance with an aspect of the present disclosure is shown in perspective in FIG. 2. The alignment tool 200 includes a body portion 204 having a distal end 208 and a proximal end 212 with a respective distal opening 216 and a proximal opening 220. Additionally, one side of the body 204 includes an opening or slot 224 in one surface 225 to accommodate the cable 108, the purpose of which is explained below. The body portion 204 may be made from a plastic, aluminum, a ceramic or a metal and manufactured by any one of a number of approaches not limited to molding, milling, additive printing, etc. The material may also be chosen to be electrostatic discharge (ESD) compliant for working with ESD sensitive devices.

Figure 3:
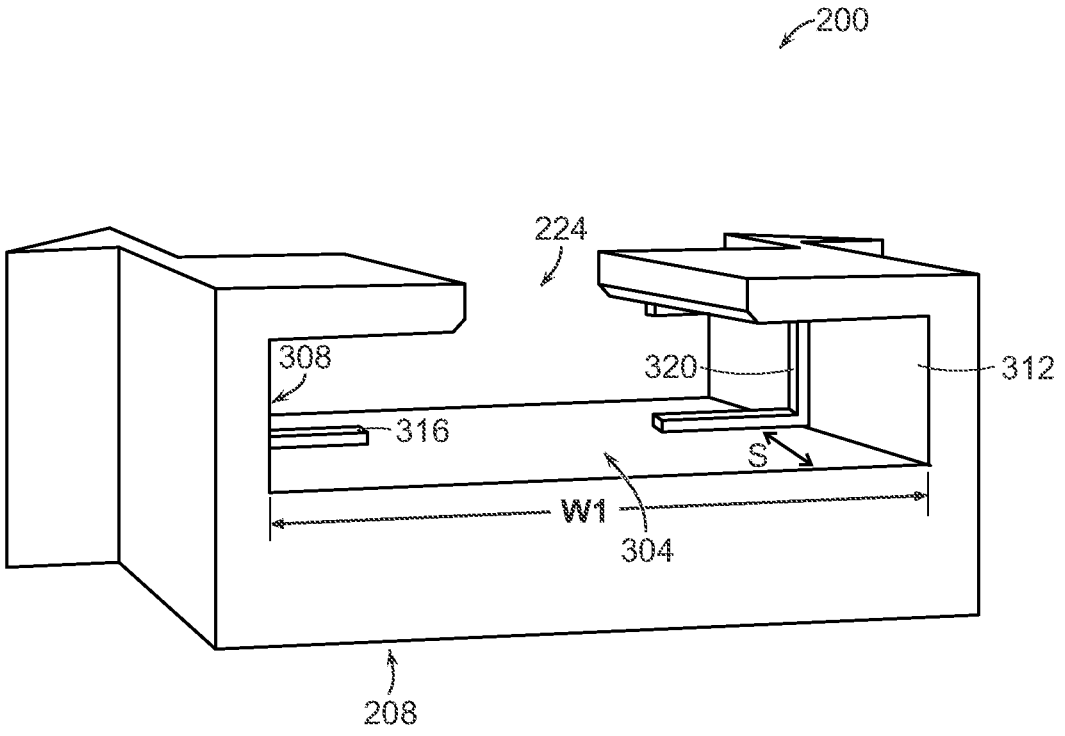
FIG. 3 is a perspective view from a distal end of the tool of FIG. 2.

Referring now to FIG. 3, a perspective view looking into the tool 200 from the distal end 208, an interior cavity 304 is sized to receive the male connector 104 in a slip fit arrangement. That is, a distance W1 between two interior and opposed walls 308, 312 is just slightly larger than a longitudinal length W of the male and female connectors 104, 154 as shown in FIG. 1. Accordingly, the male and female connectors 104, 154 can slide along the walls 308, 312 and be constrained, i.e., guided, as will be discussed in more detail below.

Figure 4:
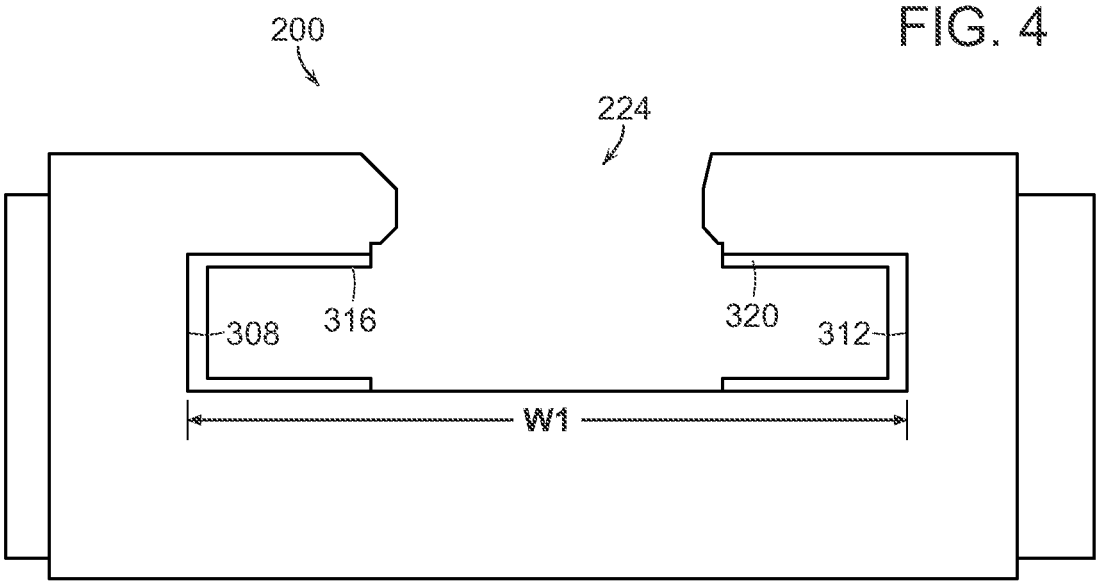
FIG. 4 is a view into the distal end of the tool of FIG. 2.
Figure 5:
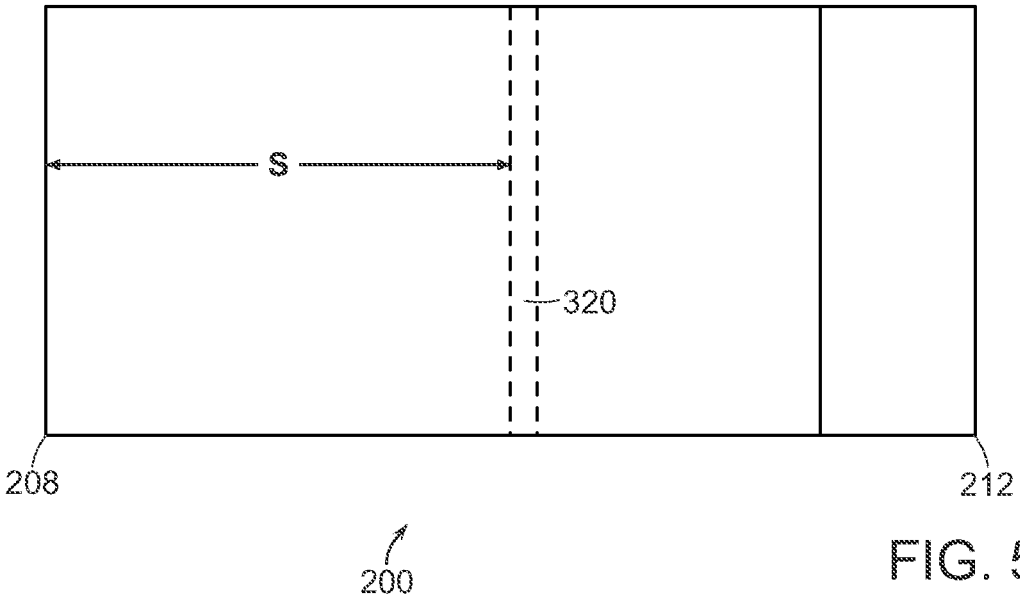
FIG. 5 is a side view of the tool of FIG. 2.

Two shoulders or stops 316, 320 extend, respectively, from the opposed walls 308, 312 and are positioned a distance S from an edge of the distal opening 216. That is, the shoulders or stops 316, 320 extend perpendicularly from the opposed walls 308, 312. The distance S is chosen to be larger than a stacked height of the male and female connectors 104, 154 when fully coupled to one another. The dimensions W1 and S are also shown in FIG. 4, a view of the tool 200 from the distal end 208, and FIG. 5, a view of the tool 200 from a direction A shown in FIG. 2.

Figure 6A:
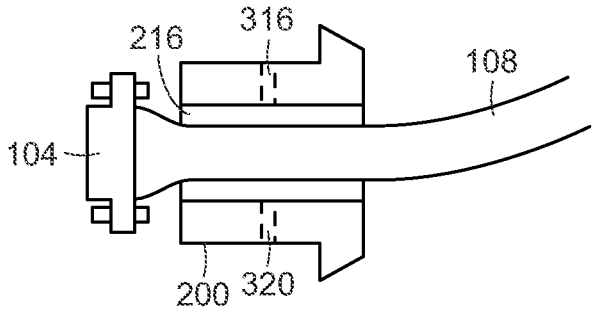
FIGS. 6A and 6B represent the tool of FIG. 2 in operation with a male connector.
Figure 6B:
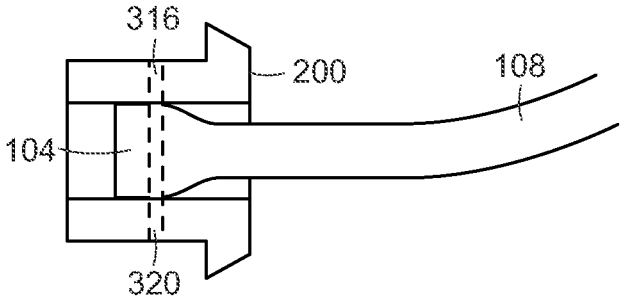

In operation, FIG. 6A, the male connector 104 is loaded into the tool 200 from the distal opening 216 and slid along the inner walls 308, 312 until the distal surface 116 of the male connector body 104 makes contact with shoulders/stops 316, 320 within the tool 200, FIG. 6B. As can be seen in FIGS. 2-5, the shoulders/stops 316, 320 do not extend all the way across the cavity 304 in order to couple to the distal surface 116 of the male connector 104 but not interfere with the captive screws 112. Advantageously, the male connector 104 squares up and is aligned within the tool 200.

Figure 7A:
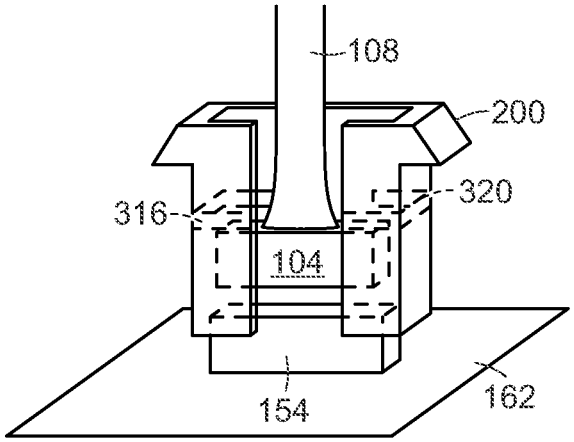
FIGS. 7A-7D represent the tool of FIG. 2 in operation with a male and female connector.

The tool 200, with the male connector 104 pushed up against the shoulder/stops 316, 320 is then installed over the corresponding female connector 154, FIG. 7A. This action aligns the tool 200 to the body of the female connector 154 and aligns the male connector 104 to the female connector 154. At this point in the process there may not be direct contact between the two connectors 104, 154, although the distal ends of the screws 112 may just be in reach of the corresponding holes 158 in the female connector 154, i.e., the tool 200 has positioned the connectors 104, 154 in proper alignment with one another.

Figure 7B:
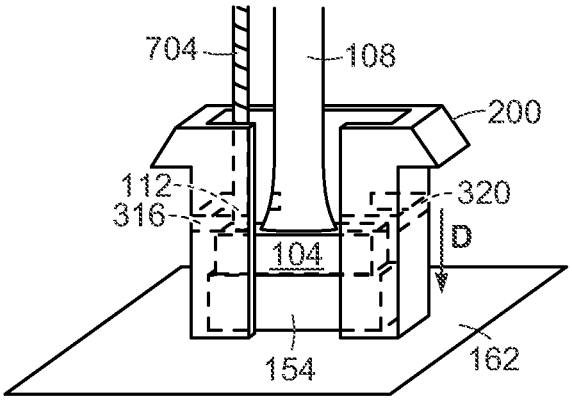
Figure 7C:
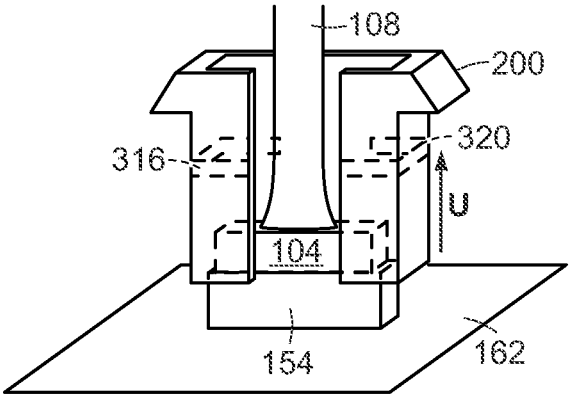
Figure 7D:
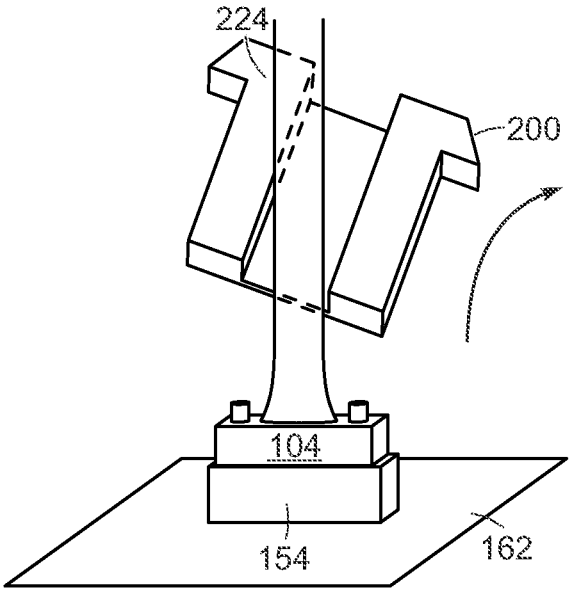

A user now moves the tool 200 further onto the female connector 154, per arrow D, until the two connectors 104, 154 come into contact with each other, FIG. 7B. At this point, the two connectors 104, 154 are properly aligned with each other and constrained in this position by the body of the tool 200. The user can then tighten the two screws 112 by inserting a tool 704, for example, a screwdriver, and secure the connectors 104, 154 to each other. Once secured, the tool 200 can be lifted, per arrow U, along the two connectors 104, 154, FIG. 7C, and once clear, removed as shown in FIG. 7D. The purpose of the slot 224 is apparent in FIG. 7D as it allows for removal of the tool 200 without having to run the tool 200 along a full length of the cable 108 where there is likely another connector on the other end around which the tool 200 cannot pass.

It is to be understood that the disclosure is not limited in its application to the details of construction and the arrangement of the components set forth herein or illustrated in the drawings as it is capable of implementations or of being practiced or carried out in various ways. Also, it is to be understood that the phraseology and terminology employed herein are for the purpose of description only and should not be regarded as limiting.

Certain features, which are, for clarity, described in the context of separate implementations, may also be provided in combination in a single implementation. Conversely, various features, which are, for brevity, described in the context of a single implementation, may also be provided separately or in any suitable sub-combination.

The present disclosure is illustratively described in reference to the disclosed implementations. Various modifications and changes may be made to the disclosed implementations by persons skilled in the art without departing from the scope of the present disclosure as defined in the appended claims.

What is claimed is:

1. An installation tool for aligning a Micro-D male connector with a Micro-D female connector, the tool comprising:

a body portion having a distal end and a proximal end;

said body portion having a cavity, defined by a first side wall and a second side wall opposite of the first side wall; and a first shoulder and a second shoulder, extending from the first and the second side walls perpendicularly into the cavity respectively, said first and second shoulders configured to contact a distal surface of the male connector; and said body portion having a distal opening and a proximal opening corresponding to the body portion distal and proximal ends respectively; and wherein a first predetermined distance between the first and second side walls provides a slip fit coupling corresponding to the Micro-D male or female connector, and wherein the first and second shoulders are positioned a second predetermined distance from the body portion distal end, the second predetermined distance is a function of a sum of the heights of male and female connectors of the Micro-D connector.

2. The tool of claim 1, further comprising:

a slot defined in a first surface of the body portion extending from the distal end to the proximal end.

3. The tool of claim 1, wherein the body portion comprises at least one of: a plastic, aluminum, a ceramic or a metal.

4. The tool of claim 1, wherein the first and second shoulders extend perpendicularly from the first and second opposed side walls.

5. The tool of claim 1, wherein the first and second shoulders extend perpendicularly from the first and second opposed side walls without interfering with a coupling portion of a male or a female connector positioned in the cavity and adjacent the first and second shoulders.

* * * * *